US005439535A

United States Patent [19]

Snagovski et al.

[11] Patent Number: 5,439,535

[45] Date of Patent: Aug. 8, 1995

[54] PROCESS FOR IMPROVING STRENGTH AND PLASTICITY OF WEAR-RESISTANT WHITE IRONS

[75] Inventors: Leonid M. Snagovski; Polina F. Nizhnikovskaja; Emil Y. Vasilev; Juri N. Taran; Viktoriya A. Bol'shakova, all of Dnepropetrovsk, Ukraine

[73] Assignee: DMK Tek, Inc., Ann Arbor, Mich.

[21] Appl. No.: 138,688

[22] Filed: Oct. 18, 1993

[51] Int. Cl.[6] ..... C21D 8/00

[52] U.S. Cl. ..... 148/544; 148/616; 148/617; 148/540

[58] Field of Search ..... 420/15, 324; 418/540, 418/544, 616, 617

[56] References Cited

U.S. PATENT DOCUMENTS

| | | | |
|---|---|---|---|
| 3,367,770 | 2/1968 | Fletcher et al. | 420/15 |
| 3,423,250 | 1/1969 | Morizumi et al. . | |
| 4,030,944 | 6/1977 | Sommer et al. . | |
| 4,721,153 | 1/1988 | Sano et al. | 420/15 |
| 5,288,346 | 2/1994 | Nizhnikovskaja et al. | 148/540 |

FOREIGN PATENT DOCUMENTS

| | | | |
|---|---|---|---|
| 56-47545 | 4/1981 | Japan | 148/324 |
| 1117025 | 6/1968 | United Kingdom . | |
| 077948 | 11/1980 | U.S.S.R. . | |

OTHER PUBLICATIONS

Sherman, A. D. et al., "Synergistically Alloyed chromium–Vanadium White Irons," *Cast Iron: A Handbook,* Metallurgiya Publishing House, Sections 7.3–7.3.4 (Moscow, Russia 1991). (with Russian equivalent).

Taran, J. N. et al., "Deformable Moderately Alloyed White Irons," *Metallovedenie i Termicheskaja Obrabotka Metallov,* No. 5, pp. 35–43 (1989) (with English translation).

Cox, G. J., "Progress in Abrasion–Resistance Alloy White Iron Development," *Foundry Trade Journal* vol. 158, No. 3307, pp. 480, 483, 484, 486 (1985).

Parent, S. et al., "Mechanical Properties and Wear Resistance of White Cast Irons," *AF5 Transactions,* vol. 80, pp. 393–400 (1972).

Parent, S. et al., "Characteristiques mecaniques et resistance a l'usure des fontes blanches," *Revue de Metallurgie,* vol. 69, No. 12, pp. 809–823 (1972).

"Special–Purpose Alloy Castings to Rest abrasion," *Bradley and Foster, Ltd.,* Dalaston, England p. 20 (1976).

Rohling, K., *Fonderia Italiana,* No. 2. pp. 58–61 (1973) and English translation thereof.

British Standard BS4844–74, Parts 1, 2 and 3, Aug. 31, 1972.

*Primary Examiner*—Deborah Yee

*Attorney, Agent, or Firm*—Harness, Dickey & Pierce

[57] ABSTRACT

Composition and process for the manufacture of wear-resistant white iron, and articles made therefrom. A melt is solidified that contains iron, carbon and at least two carbide forming elements selected from silicon, manganese, chromium or mixtures thereof. Optionally, the melt contains one or more additional alloying elements selected from vanadium, titanium, molybdenum, aluminum or mixtures thereof. The alloying elements are incorporated in the melt in proportions and amounts sufficient to form, during solidification, a eutectic that is based on a metastable, non-cementite type carbide.

13 Claims, 9 Drawing Sheets

PROCESS FOR IMPROVING STRENGTH AND PLASTICITY OF WEAR-RESISTANT WHITE IRONS

BACKGROUND OF THE INVENTION

1. Technical Field

The invention relates to white iron, and more particularly to a composition and process for the manufacture of wear-resistant white iron.

2. Discussion of the Related Art

White iron alloyed with conventional carbide forming elements generally has high hardness and wear resistance. However, in its as-cast condition, absent subsequent thermal treatment, its ability to resist shock and its fatigue strength tend to be relatively low. Additionally, it tends to exhibit relatively low plastic deformability, which is believed to be a result of the presence of a brittle eutectic phase in its structure. Consequently, plastic working of such white iron tends to be commercially impractical because of such low deformability.

A process for the manufacture of alloyed white irons having high wear resistance and, specifically, high resistance to abrasive wear is discussed in G. J. Cox, "Progress in Abrasion-Resistance Alloy White Iron Development", Foundry Trade Journal, 1985, vol. 158, no. 3307, pp. 480, 483, 484, 486.

Another process for the manufacture of white iron is discussed in A. D. Sherman and A. A. Zhukov, "Cast Iron: A Handbook", Metallurgiya Publishing House, pp. 428–434 (Moscow, Russia, 1991). The process involves providing a cast iron structure including a eutectic that is based upon a stable vanadium carbide (VC). This is accomplished by adding a relatively large and costly amount, e.g., at least 6.28%, of vanadium. Other items which may be of interest are U.S. Pat. No. 4,030,944 (Sommer et al) dated Jun. 21, 1977; No. 0779428 (Soviet Union) dated Nov. 15, 1980; Patent No. 1,117,025 (Great Britain) dated Jun. 12, 1968; and "Deformable Moderately Alloyed White Irons," by Ju. N. Taran, et al, Metallovedenie i Termicheskaja Obrabotka Metallov, 1989, No. 5, pp. 35–43 (article with English Translation). See also, U.S. application Ser. No. 07/993,959, filed on Dec. 17, 1992, now U.S. Pat. No. 5,288,341 which is a continuation of Ser. No. 07/692,560, filed on Apr. 29, 1991 (abandoned), entitled "Process for Producing Deformable White Cast Iron", incorporated by reference.

SUMMARY OF THE INVENTION

The present invention relates to an improved composition and process for the manufacture of plastically deformable wear-resistant white iron, and articles made therefrom.

The process includes the steps of preparing a melt that contains iron, carbon and at least two carbide forming elements selected from silicon, manganese, chromium or mixtures thereof. Optionally, the melt contains one or more additional alloying elements selected from vanadium, titanium, molybdenum, aluminum or mixtures thereof. The alloying elements are incorporated in the melt in proportions and amounts sufficient to form, during solidification, a eutectic that is based on a metastable, non-cementite type carbide. It is contemplated that because such carbide is metastable, it undergoes a subsequent phase transformation (i.e., decomposition) after its formation.

The melt is cooled at a rate sufficient to form a solidified portion of the melt having a metastable, non-cementite type carbide therein.

The resulting solidified material may be used directly as-cast. Optionally, it may also be heat treated to further tailor its properties and characteristics. In one aspect, bodies or ingots of white wear-resistant iron containing the eutectic based on the metastable, non-cementite-type carbide may be subjected to plastic working.

The present invention overcomes some or all of the above-discussed disadvantages of existing technology for the manufacture of wear-resistant white iron having high values of strength, plasticity and resistance to shock. In another aspect, the composition and process of the present invention may be employed in the manufacture of various articles, all of which are believed to possess commercially attractive properties.

Other objects, features and advantages of the invention will become evident from the following specification with due reference to the accompanying drawings.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings:

FIGS. 1*a*–1*c* are taken at a magnification of about 200×. FIG. 1*d* is taken at a magnification of about 800×.

DETAILED DESCRIPTION OF THE PREFERRED EMBODIMENT

Figure 1A:
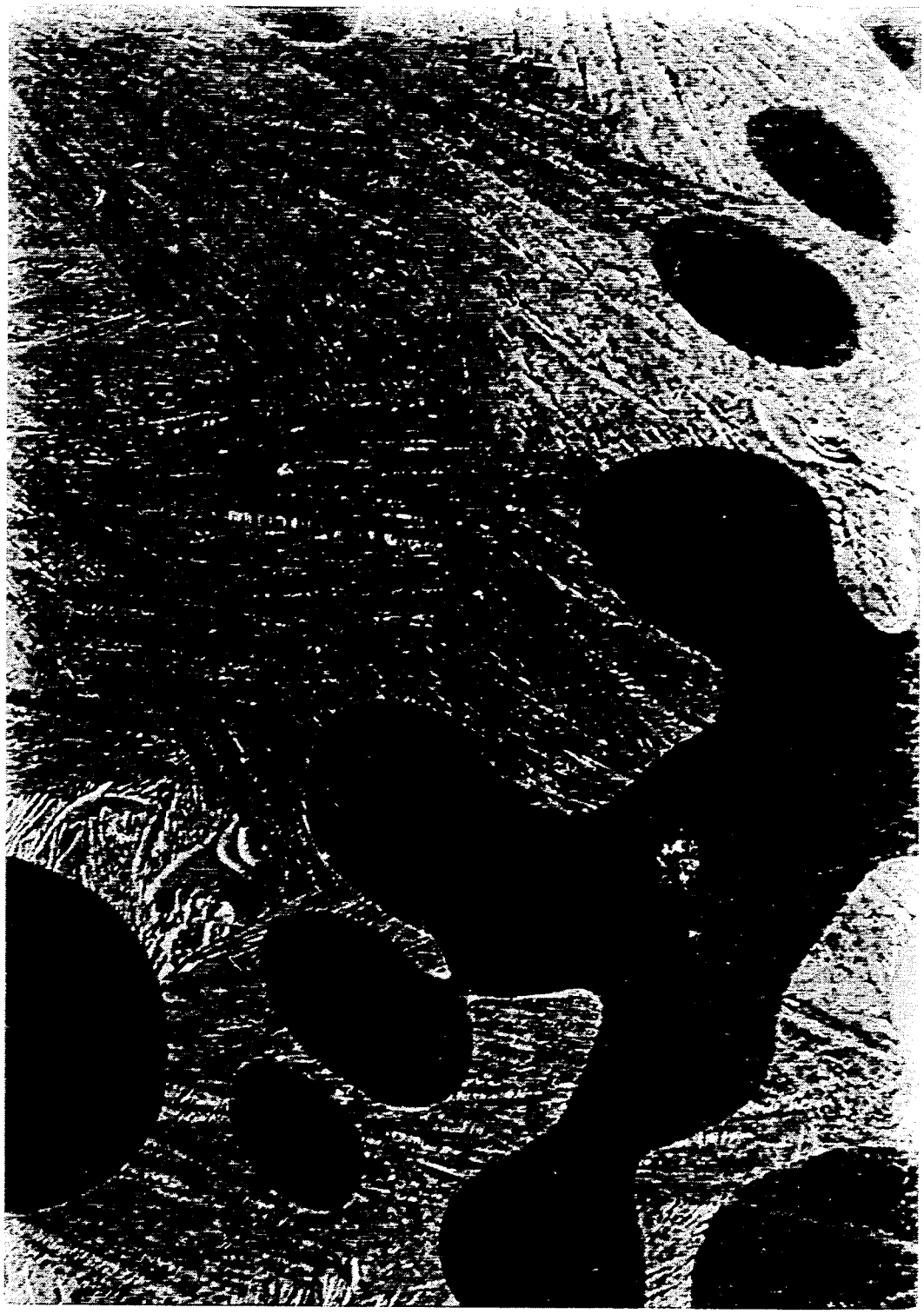
FIGS. 1*a*–1*d* are micrographs of a conventional alloy.

The present invention is predicated upon the discovery that the employment, in specific proportions and amounts, of a select group of elements in a melt composition for casting white iron yields a material with a particular microstructure that is believed to dramatically improve the properties of the resulting solidified materials in their as-cast condition. More specifically, a metastable, non-cementite type carbide is precipitated. The carbide remains as a metastable carbide even after solidification. It is believed that as-cast, the presence of the metastable, non-cementite carbide (i.e., a carbide that is substantially free of cementite) contributes to a tough, but plastically workable material. Further, it is believed that the application of loads to the material, such as encountered during plastic deformation of the material, results in a phase transformation of the metastable, non-cementite type carbide to a more stable carbide, thereby resulting in a plastically deformable material having good strength, hardness and impact characteristics.

Accordingly, the process of the present invention generally comprises steps of:

(1) preparing a melt containing:

(a) iron;

(b) carbon; and (c) at least two elements in an amount sufficient to form a eutectic that is based on a metastable, non-cementite-type carbide during solidification; and (2) cooling the melt at a rate sufficient to form a solidified portion of the melt having a metastable non-cementite-type carbide therein.

Optionally, the process further includes a step of plastically deforming (e.g., plastically working) the resulting solidified metal at a temperature and strain rate sufficient to retain after heat treating at least a portion of the metastable, non-cementite-type carbide that can transform into a more stable carbide to impart attractive properties to the material. Preferably, the amount of metastable, non-cementite-type carbide that is transformed is about 10% to about 50% by volume of the material.

The composition of the present invention, which is preferably employed in the process of the present invention, includes iron, carbon, and at least two elements selected from silicon, manganese, chromium or mixtures thereof. Optionally, it includes one or more elements selected from vanadium, titanium, molybdenum, aluminum or mixtures thereof. The proportions and amounts of each of these constituents are preferably selected so that a eutectic is formed during solidification of the melt that is based on the metastable carbide $M_7C_3$. As referred to herein in describing compounds such as $M_7C_3$, M denotes one or more of the carbide forming metal elements listed in the above discussion.

Specifically, it is preferred that the alloying elements are employed along with iron in the proportions dictated by the following equations. For instance, where the alloying elements include chromium, vanadium, manganese and carbon, the respective amounts of each (denoted as $K_x$, where x is the alloying element and K is the amount of the alloying element expressed in percent, by weight of the final composition), are:

$4 \cdot K_C - 0.1 \cdot K_{Mn} - K_{Cr} - 2K_v =$ about 2 to about 3.

Likewise, where the alloying elements include carbon, manganese, chromium, and titanium, the proportions and amounts are selected such that:

$4 \cdot K_C - 0.1 \cdot K_{Mn} - K_{Cr} - K_{Ti} =$ about 2 to about 3.

Where the alloying elements include carbon, manganese, chromium, vanadium and titanium, the proportions and amounts are selected such that:

$4 \cdot K_C - 0.1 \cdot K_{Mn} - K_{Cr} - K_v - K_{Ti} =$ about 2 to about 3, and further wherein $K_v + K_{Ti} =$ about 0.4 to about 1.0.

In one preferred embodiment, the composition preferably includes (in addition to iron) carbon in an amount of about 2.2 to about 3.6 percent, and more preferably about 2.7 to about 2.9 percent; silicon in an amount of about 0.3 to about 1.5 percent, and more preferably about 0.4 to about 0.7 percent; manganese in an amount of about 0.5 to about 8.0 percent and more preferably about 3.5 to about 4.0 percent; chromium in an amount of about 5.0 to about 11.0 percent and more preferably about 6.0 to about 8.0 percent; and optionally one or more of vanadium in an amount up to about 2.5 percent, and more preferably about 0.1 to about 0.3 percent; titanium in an amount up to about 1.0 percent and more preferably about 0.3 to about 0.6 percent; molybdenum in an amount up to about 2.0 percent; or aluminum in an amount up to about 0.15 percent. Small amounts of additional elements, such as sulfur and phosphorus are also contemplated.

In a highly preferred embodiment, the composition includes (in addition to iron) about 2.7 to about 2.9 percent carbon; about 0.4 to about 0.7 percent silicon; about 3.5 to about 4.0 percent manganese; about 6.0 to about 8.0 percent chromium; about 0.1 to about 0.3 percent vanadium; and about 0.3 to about 0.6 percent titanium.

Unless otherwise noted herein, concentrations are expressed in percent, by weight of the final composition.

It will be apparent to those skilled in the art that other elements and impurities such as phosphorus, sulfur, or the like may also be present, and are tolerable in small or trace quantities.

The melt preferably is prepared in an induction furnace by conventional melt practices, operating under conventional temperatures, conditions and atmospheres for melting and casting white iron. Of course, different furnaces and melt practices may also be used as is apparent to those skilled in the art.

After the alloying elements are absorbed by the melt, the melt is poured into a suitable mold or molds for making a solidified material body, or ingot. It is preferred that the mold be part of a system that permits cooling of the melt at a rate sufficient so that cast iron solidification is completed in at least a portion of the melt before the decomposition of the metastable non-cementite-type carbide occurs within that portion of the melt.

Any suitable mold may be used for casting. In one embodiment, a permanent mold is employed. An inner surface of the mold, i.e. a surface which defines a portion of the mold cavity which will be in contact with molten metal, is preferably coated with a graphite-containing paint. After pouring of the melt into the mold cavity, the mold can be separated, or stripped, and the cast article removed therefrom to permit the casting to air cool naturally. Preferably, this occurs after a cool-down temperature of about 800° C. to about 900° C. is reached. It is believed that cooling in accordance herewith renders the preferred microstructure discussed herein.

Solidified castings may be employed as-cast in service conditions (i.e. without subsequent thermal treatment), or, alternatively, with a subsequent suitable thermal treatment for further improvement of mechanical properties. For instance, without limitation, to provide even higher hardness and strength of products, it is preferred to anneal the as-cast material at about 900° C. for about two to about three hours, followed by a step of air cooling the material.

Optionally, a step of plastic working the cast material is employed. Such step may be employed along with a step of thermal treatment, or exclusive of it. When a step of plastic working of the cast iron is employed, the cast material preferably is subjected to a step of annealing (using conventional techniques) at one or more temperatures ranging from about 100° C. to about 400° C. below the solidus temperature of the cast material. In the present preferred embodiment the annealing step takes place within the above temperature range for a period of about three hours. Shorter or longer times may be employed.

Preferably, the step of plastic working is carried out after the above annealing step is completed, when the steps are employed in combination with each other. The temperature or temperatures employed should be sufficient so that the cast material is able to provide a level of deformability that is compatible with the end result sought. One preferred temperature range is from about 860° C. to about 1100° C. A more preferred range is from about 1000° to about 1050° C.

Although the above temperature ranges are preferred, it will be apparent to those skilled in the art that the temperatures may be lower or higher. It is recommended, however, that the temperature be high enough to prevent formation of voids, fissures and similar phenomena that could bring about a reduction in strength or deformability of the resulting material. Further, it is preferred that the temperature is not so high that localized melting will negatively affect the deformability of the material.

The plastic working may be carried out under any suitable combination of stress, amount of deformation per pass (for example, without limitation, up to about 25% or more per pass, and preferably up to about 15% during a first pass) and strain rate. Types of working include, but are not limited to conventional working techniques, e.g., tough forming as done by hammer forging, or rolling (or other forming) in blooming, bar and rod, piercing, or stretching mills. Such working may be done with any suitable equipment used for plastic working, including forging presses, bloomings, slabbings, bar and rod mills etc. Deformation during the step of plastic working may be compressive or tensile. Accordingly, the stress may be compressive or tensile, and may vary in amount depending on one or more of such conditions as temperature, strain rate, the desired amount of deformation, or the like. The strain rate is preferably between about $10^{-3}S^{-1}$ and about $10^{3}S^{-1}$, more preferably between about 0.01 and about 100, and still more preferably between about 1 $s^{-1}$ to about 10 $s^{-1}$. Preferably, a suitable intermediate anneal is done when the total amount of deformation reaches about 100%. Structure and properties may be further tailored using conventional thermal treatment and cooling techniques after plastic working.

Articles manufactured by plastic working may be subsequently subjected to thermal treatment and cooling, as may be necessary, in accordance with conventional methods for providing the desired microstructure and properties in the material.

The process of the present invention may be used advantageously for mass production of a great variety of products such as, without limitation, grinding media for various types of rock or hard materials; crushing and grinding mill components such as lining plates, scrolls, troughs and the like; strip, bars and rods, slabs, mill rolls etc. These articles exhibit improved hardness and resistance to shock in their as-cast condition, without the need for subsequent thermal treatment. Examples of other articles include, without limitation, rolled strips and bars of alloyed white iron, all of which are believed to possess commercially attractive properties.

Considerable economic savings are believed possible as a result of the process of the present invention, particularly because the white iron that is made is a viable material candidate for use in place of generally more expensive conventional high-alloy cast irons. Moreover, the attractive properties of the materials in their as cast condition obviate the need for further processing in many instances, but does not necessarily preclude such further processing to more precisely tailor the properties of the materials for their desired end use.

To further understand the benefits and advantages of the composition and process of the present invention, reference is made to the figures accompanying this specification. Referring first to FIGS. 1*a*–1*d*, these figures show the microstructures that result from the solidification of a conventional white iron composition.

More particularly, FIGS. 1*a*–1*d* show several micrographs of structures having a plurality of austenite dendrites that are believed to precipitate during early stages of solidification of a melt of conventional white iron having a composition of about 3.30% carbon, about 9.34% chromium, about 0.001% sulfur and about 0.004% phosphorus. The material is cooled at a rate of about 0.2° C. $s^{-1}$ from a first temperature, which exceeds its liquidus temperature by about 100° C., to a second temperature ranging from about 1170° C. to about 1200° C. For the structure in FIG. 1*a*, the second temperature is about 1200° C. For FIGS. 1*b*, 1*c* and 1*d*, the second temperatures (respectively) are about 1180° C., about 1178° C. and about 1170° C. FIGS. 1*a*–1*d* thus illustrate the progression of the structure during cooling.

Upon reaching the second temperature, the materials are quenched at a rate of greater than about 2000° C. $s^{-1}$ to fix the structure of the material essentially as it exists at the second temperature. The micrographs of FIGS. 1*a*–1*d* are obtained after conventional polishing and chemical etching of sections of the material. The generally continuous and black regions in the micrographs are austenite. The relatively light grey regions are generally $M_7C_3$-type carbides. The relatively white regions are $M_3C$-type carbides. The dark grey regions are generally the quenched melt, with a characteristic pattern of relatively fine eutectic.

Figure 1B:
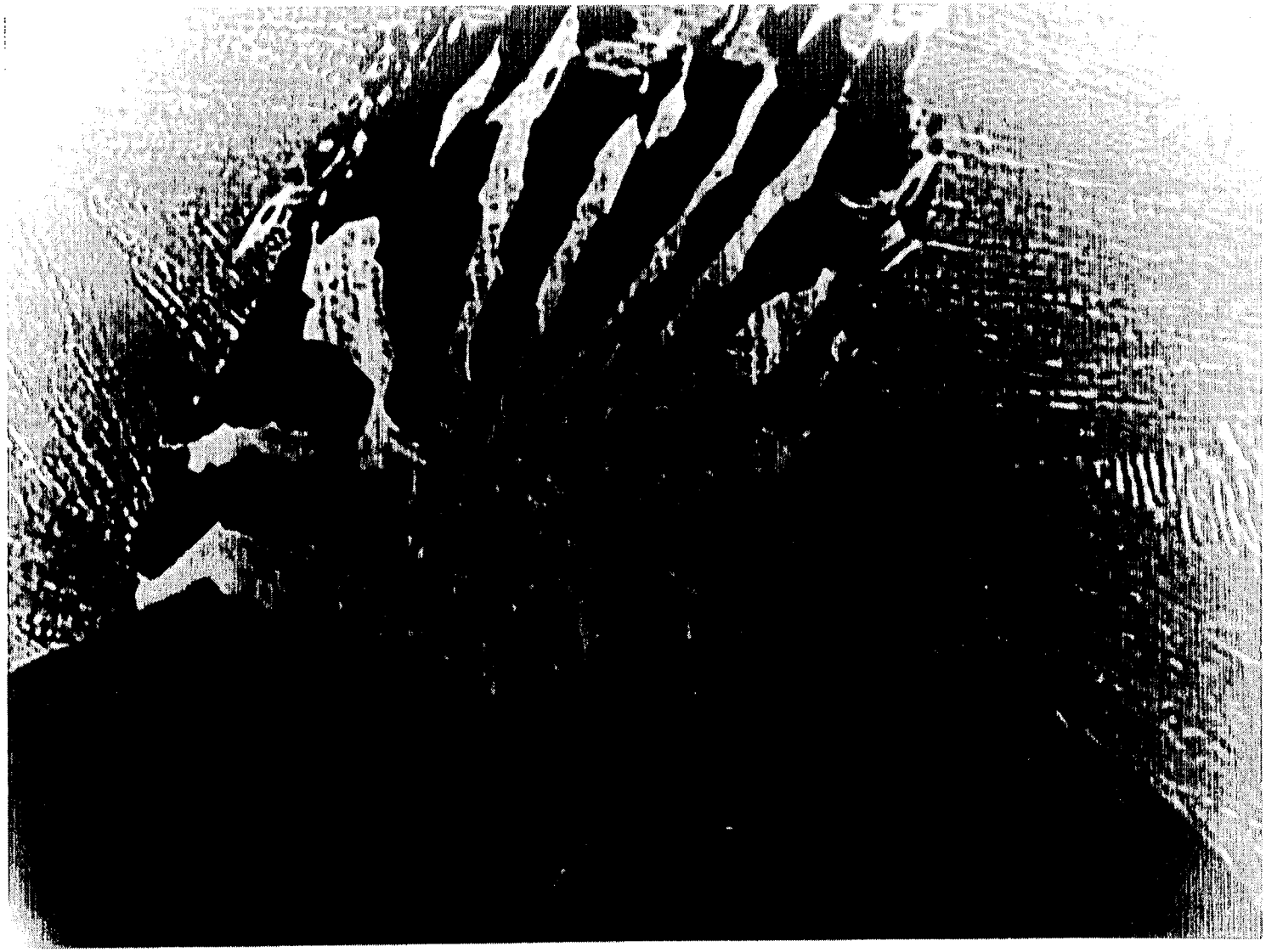
Figure 1C:
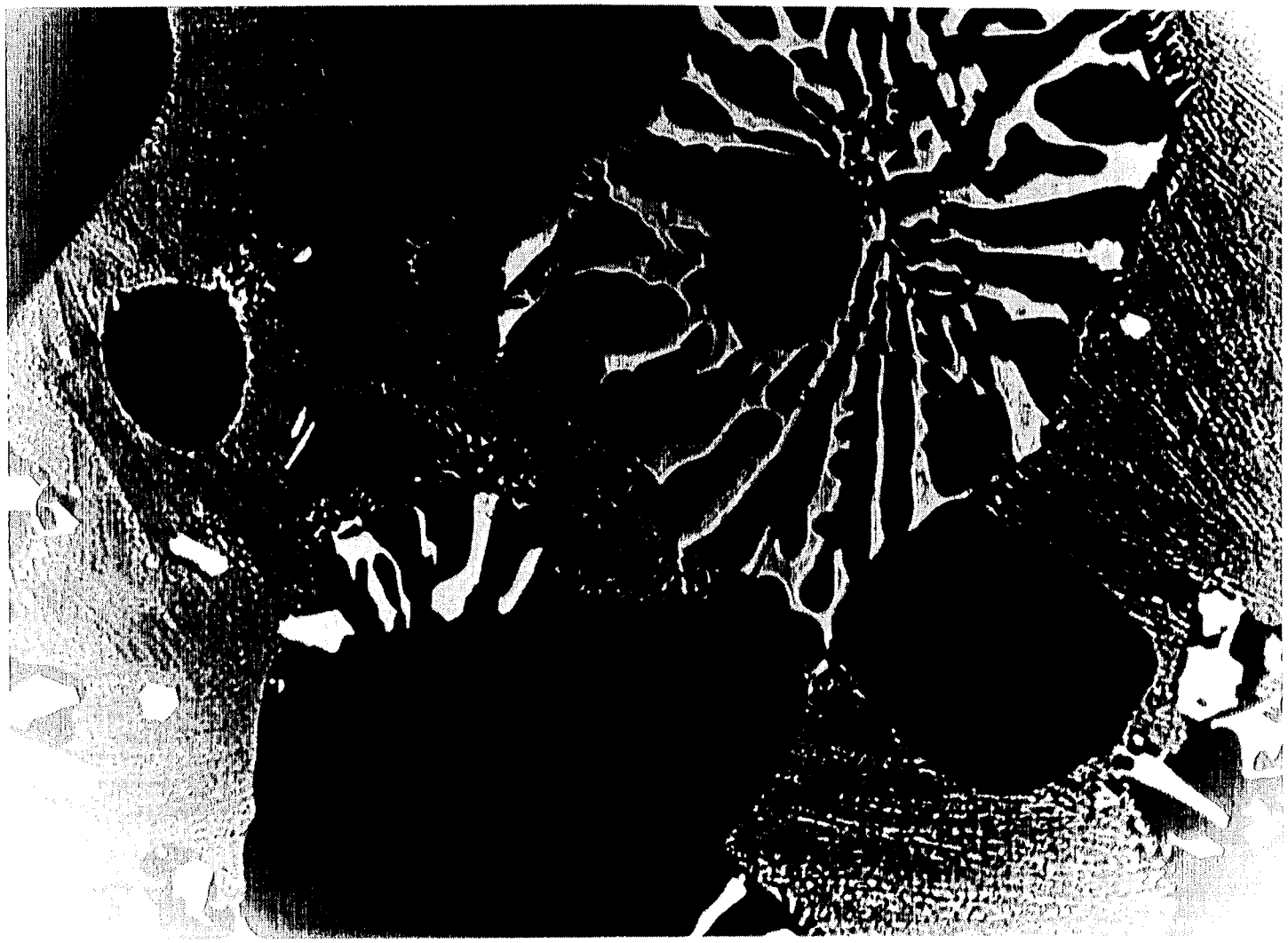
Figure 1D:
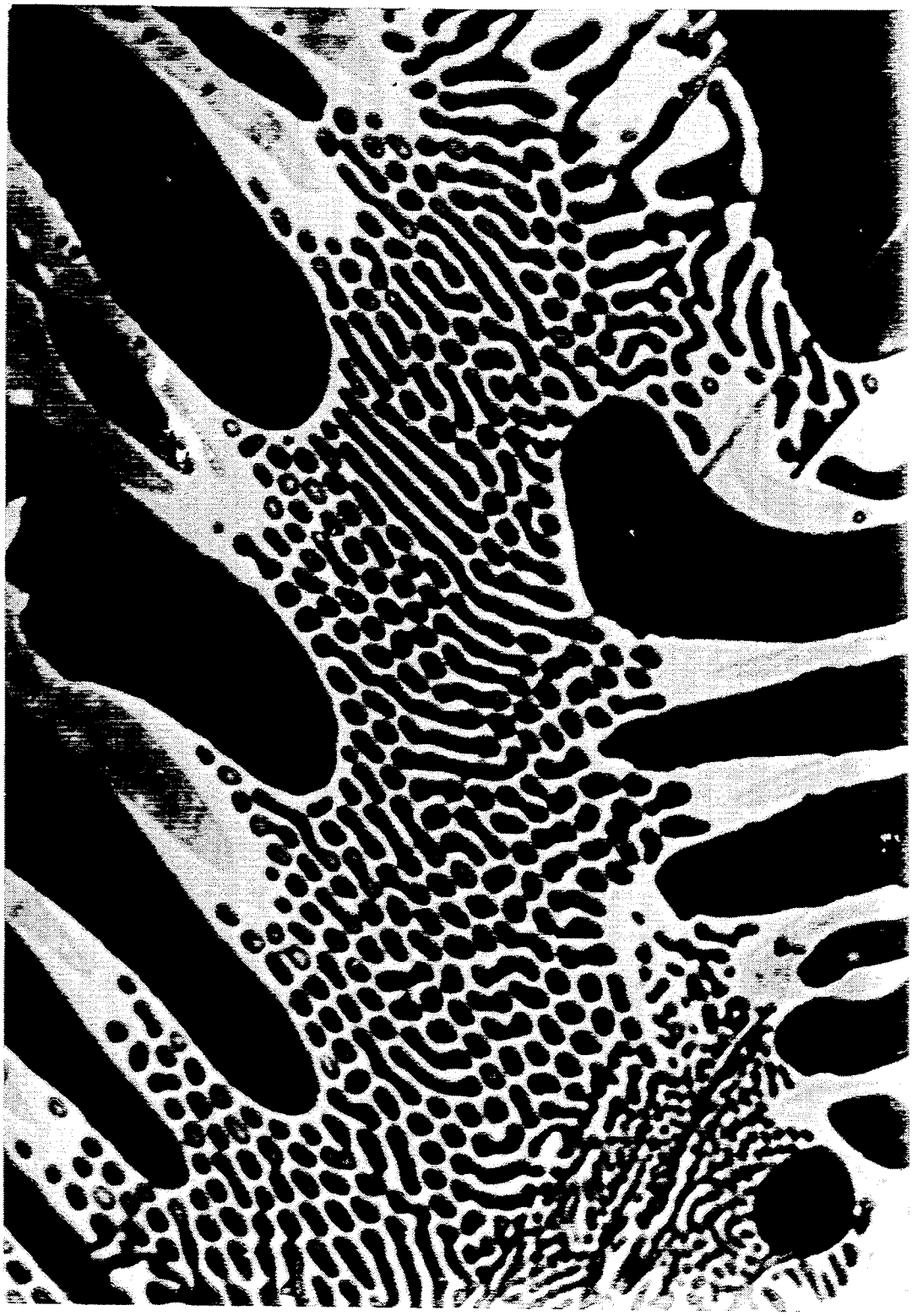

FIGS. 1*b* and 1*c* show what is believed to be the progressive formation of a microstructure including grains of eutectic that are formed as the material solidifies. During solidification, metastable carbides also are believed to form, namely $M_7C_3$. Near the final stages of solidification, a eutectic-peritectic reaction is believed to take place in which the liquid metal and the metastable carbide transform into cementite. To reiterate, even though in such conventional cast iron there is a eutectic that may be formed based on a metastable carbide, upon completion of solidification there remains what is believed to be only a eutectic based on cementite, i.e. a metastable carbide may form, but (in the context of the present invention) substantially all of it undesirably decomposes to form a stable carbide before the material is completely solidified and can be further processed, e.g., plastically worked. FIG. 1*d* depicts such a resulting microstructure.

Without intending to be bound by theory, it is believed that beneficial characteristics of the materials made according to the composition and process of the present invention are due in substantial part to the survival of substantially all or at least a major portion of the metastable, non-cementite-type carbide phase after solidification of the molten material is complete (e.g. at least about 50% percent of the initial metastable, non-cementite type carbide phase formed survives solidification). The survival of the metastable non-cementite carbide is believed to result from the employment of the aforementioned alloying elements in the stated proportions and amounts. In particular, without intending to be bound by theory, when alloying according to the composition and process of the present invention, atoms of the alloying elements are believed to migrate into the lattice structure of the metastable carbide. During the eutectic-peritectic reaction the atoms of the alloying elements are believed to dramatically reduce the dissolution (and hence transformation) rate of the metastable carbide during the eutectic-peritectic reaction. The transformation of the metastable carbide to a more stable carbide, e.g., to cementite, therefore is delayed and is not completed or even does not begin, and the metastable non-cementite-type carbide remains present in the solidified cast iron.

Figure 2:
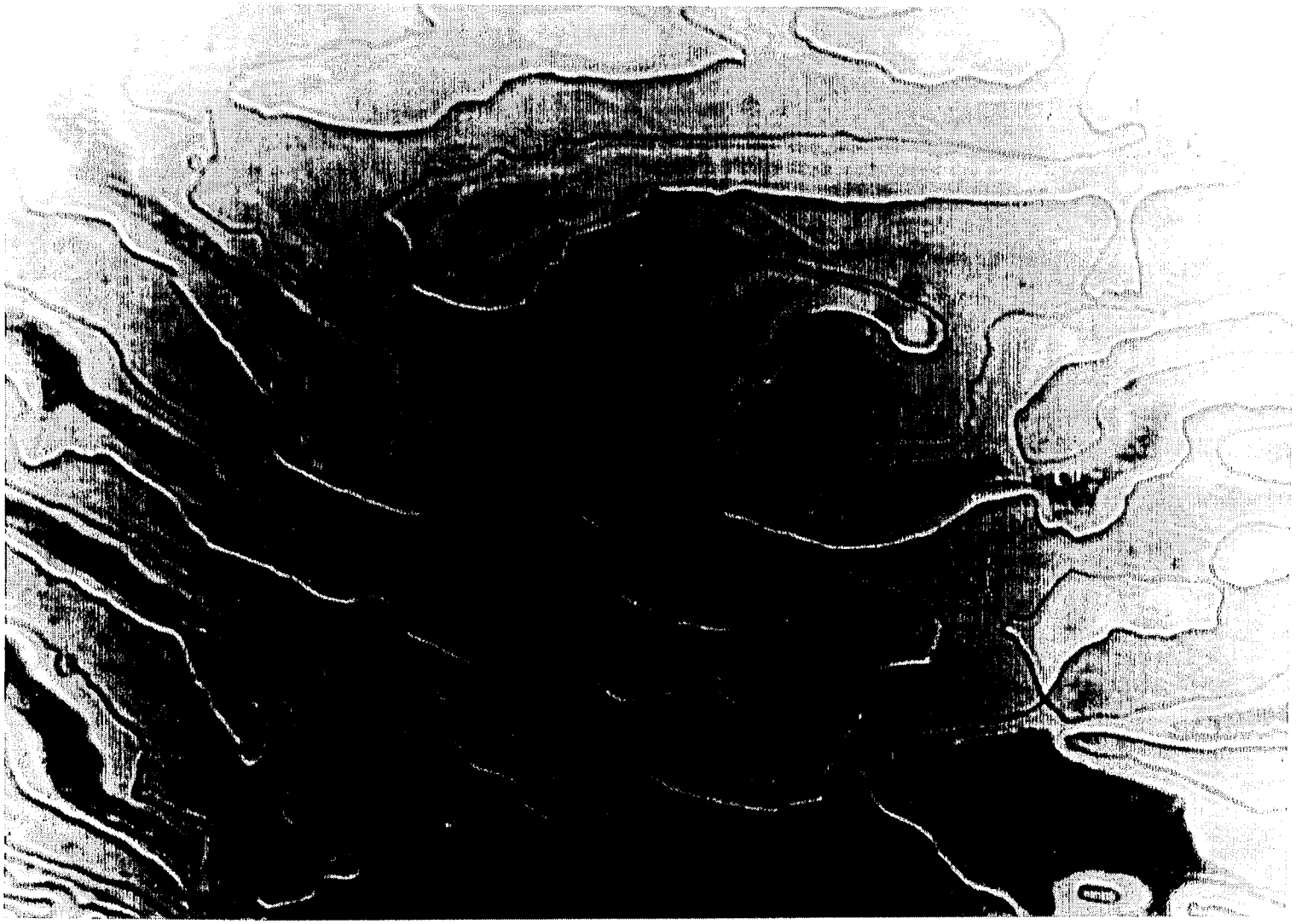
FIG. 2 is a micrograph of an alloy in accordance with the present invention, at a magnification of about 400×.

FIG. 2 illustrates an alloy in accordance with the present invention. The material shown in FIG. 2 has a composition of about 3.18% carbon, about 5.14% chromium, about 2% vanadium, about 0.001% sulfur, and about 0.001% phosphorus. Samples are prepared and heated substantially as the material of FIGS. 1*a*–1*d*. Etching includes a suitable chemical and thermal etch. Segregation of alloying elements both in the solid solution and in the matrix is detected. On the micrograph of FIG. 2, $M_7C_3$-type carbide varies in color from black to white, depending on the Cr content, and its particles are surrounded generally by gray shells of $M_3C$. Solid solution is generally light-gray in the eutectic and dark-gray in other places. FIG. 2 illustrates the final stage of four-phase eutectic-peritectic transformation:

$$L+M_7C_3 \rightarrow \gamma+M_3C;$$

wherein L refers to the liquid from the melt.

By contrast with conventional compositions and processes, according to the composition and process of the present invention, the metastable non-cementite carbide thus is available during later processing steps, such as the step of plastic deformation, and facilitates such deformation. It is during the later processing steps when the phase transformation from the metastable non-cementite-type carbide to a more stable carbide preferably takes place. In accordance with the composition and process of the present invention, such phase transformation is believed to induce plasticity in the solidified material, and substantially aids in the prevention of crack initiation and propagation. A remarkable improvement in shock resistance may likewise be attributable to a transformation of the metastable carbide into another, more stable one in areas where deformation is confined at the austenite/eutectic carbide interface during impact. Advantageously, stress relaxation during impact can occur through plastic deformation at a service temperature which may be as low as room temperature.

Figure 3:
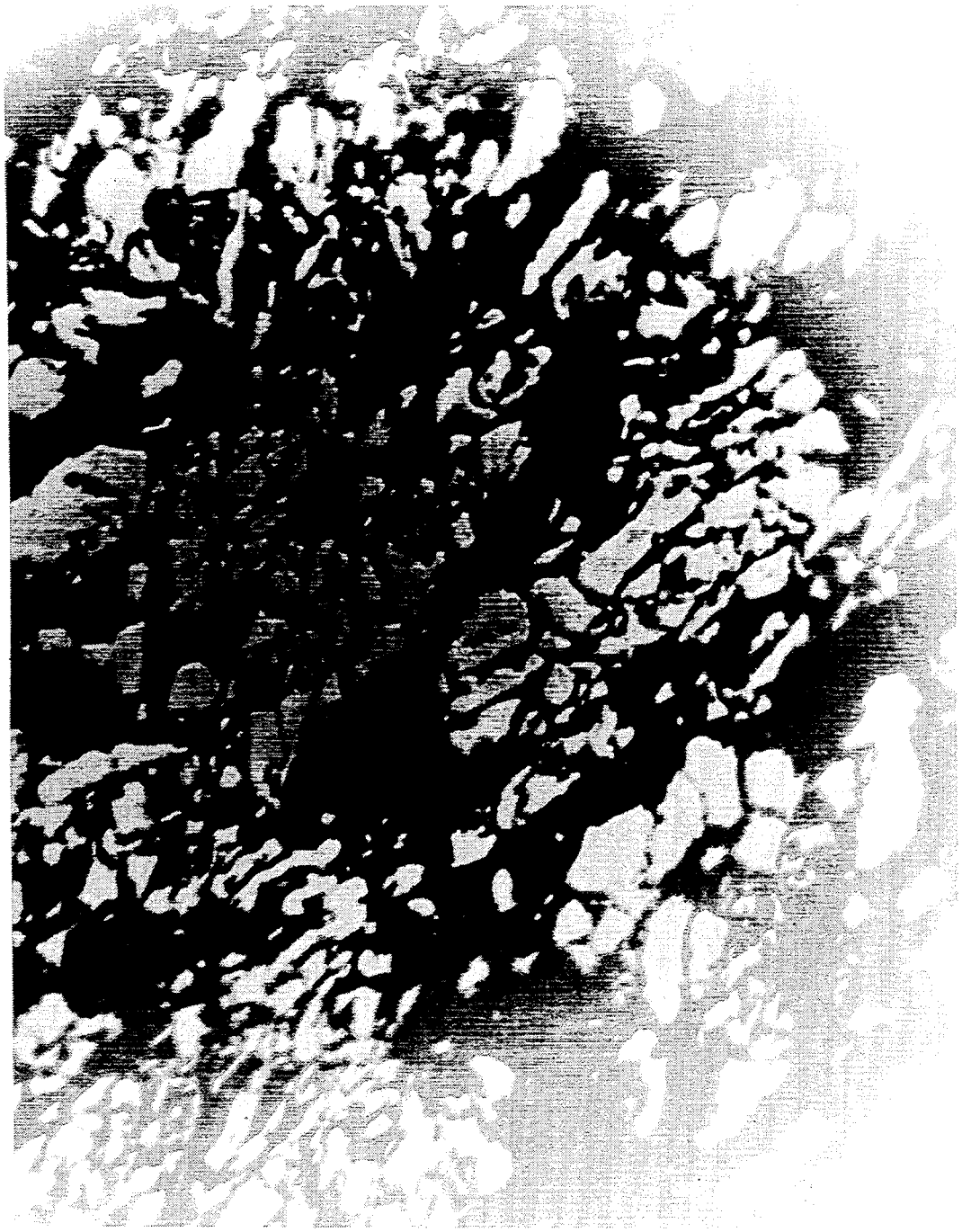
FIG. 3 is a surface micrograph of a grinding ball.

FIG. 3 depicts the microstructure of a grinding ball having an approximate composition of 3.2% carbon, 1.5% silicon, 0.4% manganese, 5.0% chromium, 2.0% vanadium, below about 0.12% sulfur and below about 0.15% phosphorus. It is prepared by induction melting iron from any commercially available substantially pure raw material, and pouring the resulting molten material into a permanent mold disposed in a suitable ball-casting machine for making balls having a diameter of about 60 min. Resulting balls which preferably are about 60 mm in diameter are removed from the molds while at a temperature of about 900° C. to about 960° C. and cooled in the air, preferably without any blasting. No thermal treatment of castings is carried out. In order to evaluate the impact fatigue strength, ball tests are performed using an impact machine with an impact energy of 650 J. FIG. 3 shows the microstructure of a ball after 350 impacts.

Figure 4A:
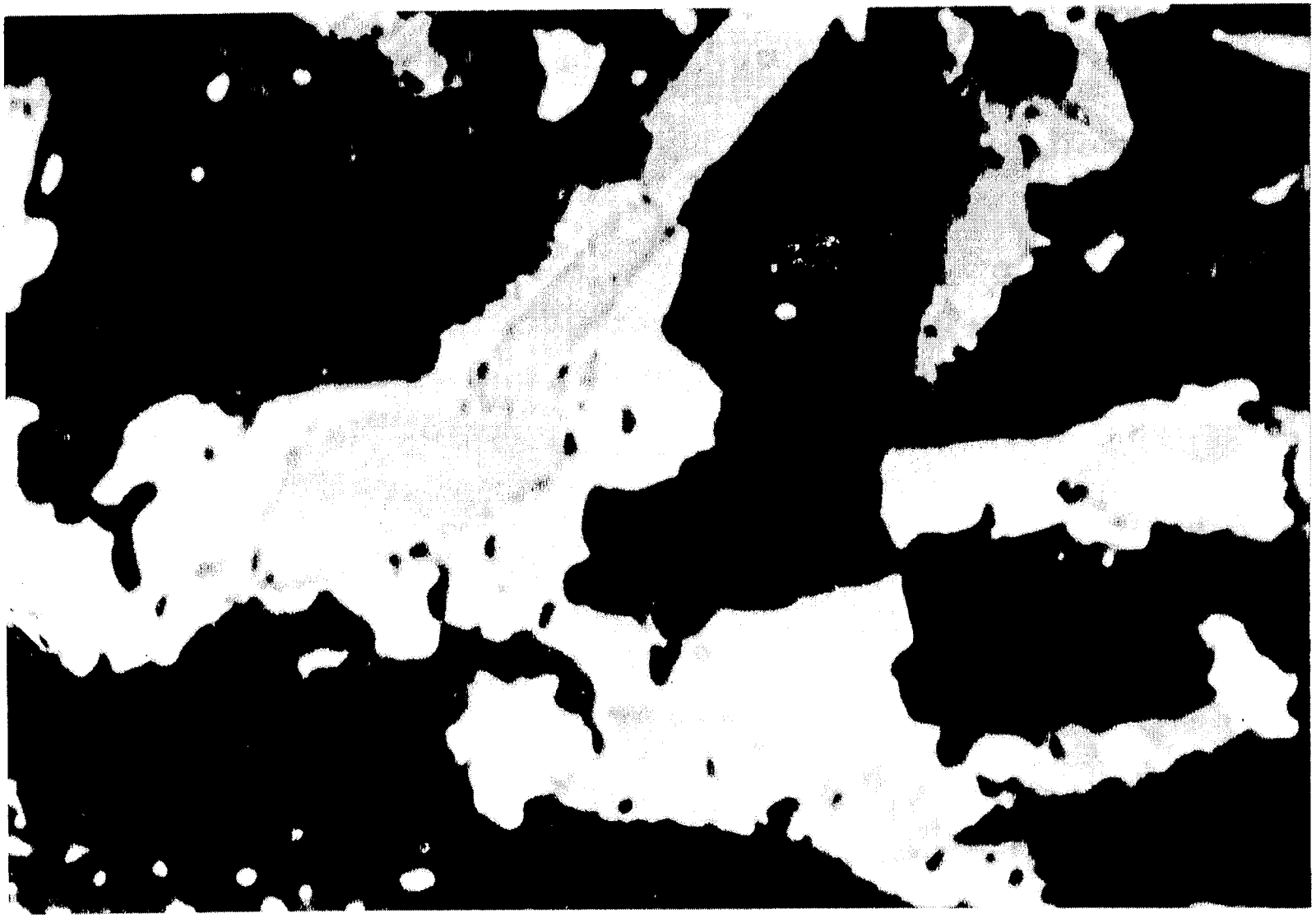
FIG. 4*a* and 4*b* are micrographs of an alloy in accordance with the present invention.
Figure 4B:
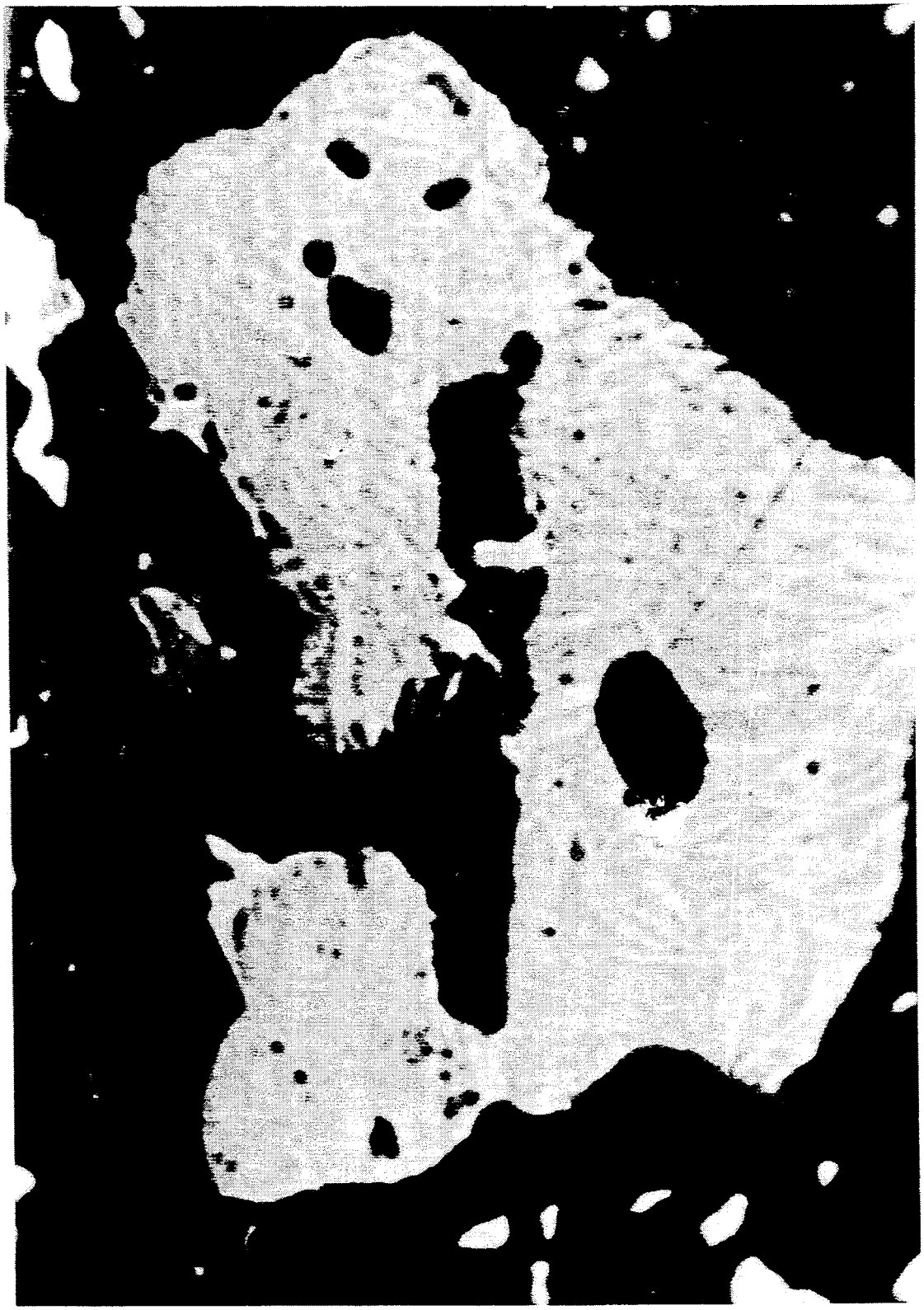

FIGS. 4*a* and 4*b* show the microstructure of an alloy having a composition of about 2.75 percent carbon, about 5.2 percent chromium, about 2 percent vanadium, about 0.3 percent silicon and about 0.4 percent manganese. FIG. 4*a* and FIG. 4*b* show sections after conventional mechanical polishing followed by chemical and thermal etching. Dark areas on these micrographs mainly correspond to austenite decomposition products. Greyish areas mainly correspond to $M_7C_3$ type carbides. Lighter areas mainly correspond to $M_{23}C_6$ carbides. The fabrication steps that result in this structure are described in Example 47. In that material, it is believed that a shift transformation from $M_7C_3$ to $M_{23}C_6$ takes place at a rate about 100 $s^{-1}$, a deformation temperature of at least about 1050° C. and a deformation greater than about 80%. This transformation is believed to start in regions generally confined to the austenite matrix/eutectic carbide interface, and is believed to induce stress relaxation at the interface. It is believed that the metastable non-cementite-type carbide absorbs energy imparted to the material (e.g.,energy imparted during plastic deformation), and employs such energy advantageously to transform the metastable non-cementite-type carbide to a more stable carbide, while at the same time helping to prevent crack initiation and propagation. The result is that the material may be plastically deformed to a greater degree than conventional white iron, but still ultimately have beneficial hardness and strength characteristics. This transformation-induced plasticity effect in carbides improves the overall plasticity of the alloy, for example, as high as a factor of about 2.5 to about 3. It is also believed that since the transformation of $M_7C_3$ to $M_{23}C_6$ is reversible, holding the material at a temperature, during plastic working, of about 860° C. to about 1100° C. facilitates restoration of a reserve of plasticity.

Figure 5:
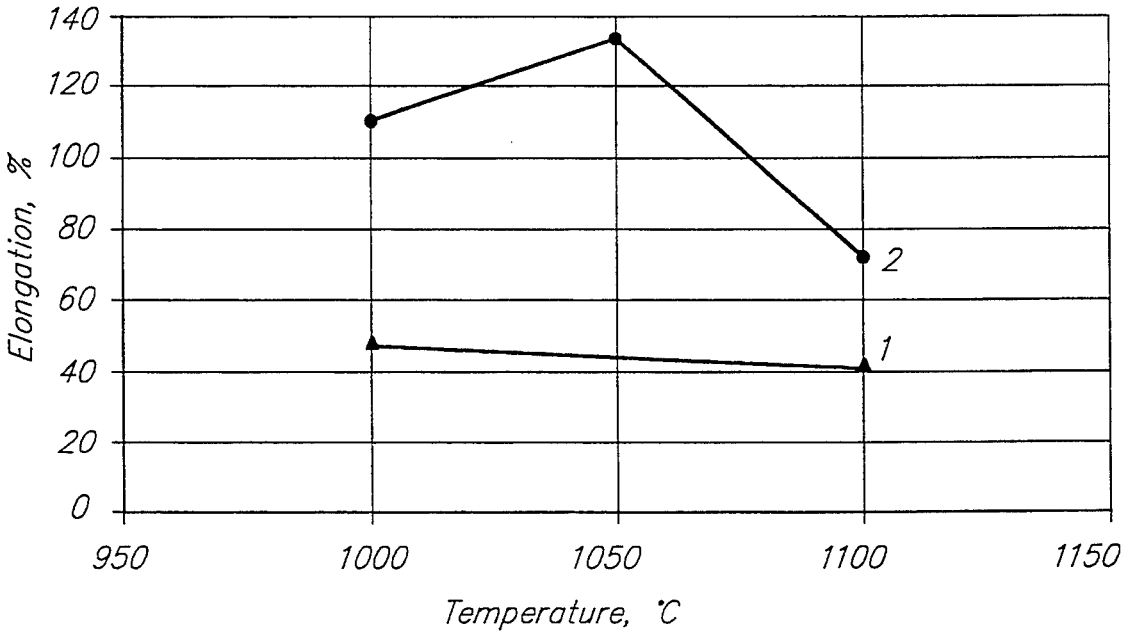
FIG. 5 is a graph of certain material characteristics.

FIG. 5 shows plots comparing elongation of a conventional white iron (having the composition 2.7% carbon, 16% chromium, and the balance iron, so that it has a stable eutectic based on $M_7C_3$), indicated by the curve of plot 1, and a material prepared according to the composition and process of the present invention (having the composition of about 2.7% carbon, about 5.5% chromium, and about 2.2% vanadium, so that it has a eutectic in which $M_7C_3$ changes into $M_{23}C_6$ during plastic working), indicated by plot 2. The plots are obtained from hot tensile testing the materials at the temperatures indicated on the x-axis of the plot. The as-cast compositions have general similar amounts of eutectic constituent in the material.

The present invention is further illustrated by the following examples, which are not intended as limiting.

EXAMPLES 1–46

Materials are melted in an induction furnace from commercially available raw materials. Among these are steelmaking pig iron, steel scrap, ferrosilicon, ferromanganese, ferrochromium, ferrovanadium and ferromolybdenum. The melts are poured into permanent molds to produce ingots ranging in size from about 0.5 kg to about 25 kg. Samples are cut out from the ingots and machined or otherwise suitably prepared for mechanical testing in which bending strength, impact strength and hardness are measured. The specimens are thermally treated before the tests by annealing at 860° C. and air cooling at a rate of about 20 to about 25° C./min. The materials of Examples 1–37 can be plastically worked according to the parameters set forth previously.

Bending strength is measured on specimens that are about 12 mm in diameter. Each specimen is supported at its ends by supports spaced apart at a distance of about 160 mm, and each specimen is loaded generally at its center (relative to the ends).

Tensile tests are carried out on specimens having an intermediate region having a length of about 30 mm over which the diameter is about 5 mm.

Impact tests are performed on unnotched specimens measuring about 10 mm×10 mm×55 mm. Each specimen is supported adjacent it ends by supports spaced apart by about 50 mm. However, the dimensions and spacing could be varied, such as if another machine is employed. In the present examples, the energy released by the testing machine die in the impact is about 50 J.

For hardness measurements, a Rockwell tester having a diamond indentor is used, with the full load on the indentor being about 150 kg.

Data for the various alloys of Examples 1–37 are given in Table 1.

At the bottom of the table (Examples Nos. 38–46) there are compositions and properties of what are believed to be conventional cast irons thermally treated to achieve their respective optimal conditions.

TABLE 1

| | Iron | Chemical composition (%) C | Si | Mn | Cr | V | Ti | Mo | Cu | Al | Nl | Bending strength, MPa | Charpy impact value kJ/m² | Hardness Rc |
|---|---|---|---|---|---|---|---|---|---|---|---|---|---|---|
| 2 | Cr—V | 2.7 | 0.7 | 5.3 | 6.5 | 1.5 | — | — | — | — | — | 1140 | 120 | 56 |
| 3 | Cr—V | 2.9 | 2.6 | 6.8 | 6.3 | 1.2 | — | — | — | — | — | 1230 | 158 | 57 |
| 4 | Cr—V | 3.2 | 1.3 | 5.9 | 7.0 | 1.3 | — | — | — | — | — | 1310 | 117 | 56 |
| 5 | Cr—V | 3.0 | 2.5 | 8.4 | 5.2 | 0.2 | — | — | — | — | — | 750 | 78 | 49 |
| 6 | Cr—V | 3.1 | 1.0 | 3.6 | 7.5 | 1.5 | — | — | — | — | — | 590 | 61 | 58 |
| 8 | Cr—V—Ti | 3.4 | 0.4 | 6.2 | 9.6 | 0.3 | 0.4 | — | — | — | — | 1230 | 135 | 56 |
| 9 | Cr—V—Ti | 3.6 | 0.2 | 5.8 | 11.1 | 0.1 | 0.4 | — | — | — | — | 1620 | 148 | 50 |
| 10 | Cr—V—Ti | 2.3 | 1.3 | 3.0 | 6.1 | 0.1 | 0.6 | — | — | — | — | 1120 | 111 | 62 |
| 11 | Cr—V—Ti | 2.7 | 0.4 | 3.5 | 7.4 | 0.3 | 0.3 | — | — | — | — | 1010 | 140 | 60 |
| 12 | Cr—V—Ti | 2.9 | 0.7 | 4.0 | 8.0 | 0.3 | 0.4 | — | — | — | — | 1080 | 104 | 63 |
| 13 | Cr—V—Ti | 3.0 | 0.5 | 3.9 | 8.4 | 0.3 | 0.1 | — | — | — | — | 1190 | 140 | 60 |
| 14 | Cr—V—Ti | 3.2 | 0.8 | 4.4 | 9.2 | 0.4 | 0.3 | — | — | — | — | 1100 | 108 | 60 |
| 15 | Cr—V—Ti | 3.6 | 0.6 | 4.9 | 10.7 | 0.2 | 0.3 | — | — | — | — | 1300 | 97 | 61 |
| 16 | Cr—V—Ti | 2.8 | 1.6 | 3.8 | 6.2 | 1.0 | 1.5 | — | — | — | — | 690 | 60 | 56 |
| 17 | Cr—V—Ti | 3.2 | 0.5 | 4.1 | 8.0 | 0.5 | 1.0 | — | — | — | — | 710 | 69 | 51 |
| 19 | Cr—V—Ti—Mo | 2.7 | 0.8 | 3.8 | 7.0 | 0.8 | 0.1 | 1.8 | — | — | — | 1040 | 90 | 60 |
| 20 | Cr—V—Ti—Mo | 2.9 | 1.2 | 3.0 | 9.8 | 1.0 | 0.1 | 1.1 | — | — | — | 990 | 104 | 64 |
| 21 | Cr—V—Ti—Mo | 3.0 | 0.4 | 4.6 | 8.6 | 0.3 | 0.3 | 0.6 | — | — | — | 1340 | 104 | 60 |
| 22 | Cr—V—Ti—Mo | 3.0 | 0.6 | 4.9 | 10.6 | 0.1 | 1.0 | 1.0 | — | — | — | 1500 | 91 | 60 |
| 23 | Cr—V—Ti—Mo | 3.3 | 0.8 | 3.8 | 7.3 | 0.1 | 0.4 | 2.0 | — | — | — | 990 | 87 | 64 |
| 24 | Cr—V—Ti—Mo | 3.3 | 1.0 | 4.1 | 8.5 | 0.5 | 0.3 | 1.4 | — | — | — | 1170 | 113 | 61 |
| 25 | Cr—V—Ti—Mo | 3.5 | 0.7 | 5.0 | 9.1 | 0.3 | 0.4 | 0.8 | — | — | — | 1300 | 87 | 61 |
| 26 | Cr—V—Ti—Mo | 2.2 | 1.4 | 4.6 | 11.8 | 0.2 | 0.2 | 2.2 | — | — | — | 850 | 76 | 58 |
| 27 | Cr—V—Ti—Mo | 3.1 | 0.8 | 4.2 | 7.8 | 0.8 | 0.08 | 0.05 | — | — | — | 800 | 55 | 63 |
| 29 | Cr—Ti—Al | 2.5 | 1.1 | 3.0 | 7.2 | — | 0.5 | — | — | 0.1 | — | 1430 | 118 | 60 |
| 30 | Cr—Ti—Al | 2.6 | 1.1 | 3.5 | 7.2 | — | 0.7 | — | — | 0.15 | — | 1240 | 109 | 61 |
| 31 | Cr—Ti—Al | 3.0 | 1.6 | 3.9 | 8.6 | — | 0.4 | — | — | 0.04 | — | 1080 | 108 | 65 |
| 32 | Cr—Ti—Al | 3.0 | 0.7 | 3.6 | 8.8 | — | 0.5 | — | — | 0.08 | — | 1570 | 115 | 60 |
| 33 | Cr—Ti—Al | 3.2 | 0.3 | 3.8 | 9.7 | — | 0.3 | — | — | 0.05 | — | 980 | 106 | 64 |
| 34 | Cr—Ti—Al | 3.4 | 1.2 | 4.8 | 9.5 | — | 0.7 | — | — | 0.07 | — | 980 | 111 | 59 |
| 35 | Cr—Ti—Al | 3.6 | 0.6 | 5.0 | 10.5 | — | 1.0 | — | — | 0.05 | — | 1500 | 101 | 60 |
| 36 | Cr—Ti—Al | 2.8 | 1.2 | 3.8 | 12.1 | — | 0.5 | — | — | 0.08 | — | 850 | 68 | 60 |
| 37 | Cr—Ti—Al | 3.2 | 0.8 | 3.0 | 8.9 | — | 0.7 | — | — | — | — | 610 | 51 | 62 |
| | Conventional: | | | | | | | | | | | | | |
| 38 | 260NiCr4.2 | 2.8 | 0.5 | 0.5 | 1.9 | — | — | — | — | — | — | 390 | — | 60 |
| 39 | 330NiCr4.2 | 3.3 | 0.5 | 0.5 | 1.9 | — | — | — | — | — | — | 350 | — | 60 |
| 40 | 300CrNiSi9.5.2 | 3.0 | 1.9 | 0.5 | 9.0 | — | — | <0.5 | — | — | — | 600 | — | 60 |
| 41 | 300CrMo15.3 | 3.0 | 0.5 | 0.8 | 15.5 | — | — | 2.0 | <1 | — | <0.7 | 730 | 69 | 60 |
| 42 | 300CrMo27.1 | 3.6 | 1.0 | 0.7 | 25.0 | — | — | 1.5 | — | — | — | 860 | 69 | 55 |
| 43 | 340Cr15 | 3.4 | 0.5 | 0.7 | 15.4 | — | — | — | — | — | — | 992 | 76 | 53 |
| 44 | 360CrMo15.3 | 3.6 | 0.6 | 0.7 | 14.7 | — | — | 2.9 | — | — | — | 833 | 62 | 65 |
| 45 | 360CrVI6.6 | 3.6 | 0.7 | 0.7 | 16.1 | 6.3 | — | — | — | — | — | 617 | 30 | 63 |
| 46 | 340CrNi8.6 | 3.4 | 0.6 | 0.7 | 7.8 | — | — | — | — | — | 6.2 | 819 | 48 | 61 |

EXAMPLE 47

In an electric induction furnace with a basic lining, and no protective atmosphere, a melt is prepared containing 2.75% carbon, 5.2% chromium, 2% vanadium, 0.3% silicon, and 0.4% manganese. The alloying elements are added by providing a pig-iron charge, followed by steel scrap and appropriate amounts of ferroalloys. Ferromanganese is added to provide the appropriate manganese content, after skimming slag from the melt. The melt temperature is maintained at about 80° C. to about 100° C. above the liquidus temperature. A ladle is employed during pouring and should preferably be maintained at about 50° C. to about 60° C. above the liquidus temperature of the metal. The molten metal is poured into generally square shaped molds to form ingots of about 250 kilograms. The ingots are plastically worked by hammer forging at a temperature of about 950° C. to about 1050° C. to produce billets having a diameter of about 50 millimeters, and plates having a thickness of about 30 millimeters and a width of about 100 millimeters. The plates are subjected to annealing for about 2 hours at a temperature of about 950° C., followed by a furnace cool. Resulting forged plates from the above hammer forging step, are rolled to yield bands having a thickness of about 2.2 to about 2.4 millimeters.

Thermal treatment of the articles is effected in a batch furnace, without any protective environment. A grated box with a capacity of about 1 ton is used for charging the articles into the furnace. Upon completion of the thermal treatment, a deflected airstream from a generally high-pressure fan is directed toward the box. Upon cooling the castings to a temperature of about 300° C., the airflow is stopped. The resulting mechanical characteristics of the materials of the articles are an impact strength of about 0.99 $MJ/m^2$, a tensile strength of about 910 MPa and a hardness of about 29 Rockwell C.

Although the invention has been described with particular reference to certain preferred embodiments thereof, variations and modifications can be effected within the spirit and scope of the following claims.

What is claimed is:

1. A method of improving strength and plastic properties of wear-resistant cast iron, comprising the steps of:

(a) preparing a melt comprising:
  (1) iron;
  (2) carbon in an amount of about 2.2 to about 3.6 percent, by weight of the final composition;
  (3) silicon in an amount of about 0.3 to about 1.5 percent, by weight of the final composition;
  (4) manganese in an amount of about 0.5 to about 8.0 percent, by weight of the final composition;
  (5) chromium in an amount of about 5.0 to about 11.0 percent, by weight of the final composition; and
  (6) vanadium in an amount of about 0 to about 2.5 percent, by weight of the final composition;

(b) forming a metastable non-cementite-type carbide in a solidified portion of said melt; and (c) plastically deforming a material prepared from said melt.

2. The method according to claim 1 wherein said vanadium is present in an amount of about 0.1 to about 0.3 percent, by weight of the final composition.

3. The method according to claim 1 wherein said melt of said preparing step (a) further comprises titanium in an amount of about 0 to about 1.0 percent, by weight of the final composition.

4. The method according to claim 1 wherein said melt of said preparing step (a) further comprises molybdenum in an amount of about 0 to about 2.0 percent, by weight of the final composition.

5. The method according to claim 1 wherein said melt of said preparing step (a) further comprises aluminum in an amount of about 0 to about 0.15 percent, by weight of the final composition.

6. The method according to claim 1 further comprising annealing said material at a temperature ranging from about 100° C. to about 400° C. below the solidus temperature of said material prior to said plastically deforming step (c).

7. A method of improving strength and plasticity properties of wear-resistant cast iron, comprising the steps of:

(a) preparing a melt consisting essentially of:
  (i) iron;
  (ii) carbon in an amount of about 2.7 to about 2.9 percent, by weight of the final composition;
  (iii) silicon in an amount of about 0.4 to about 0.7 percent, by weight of the final composition;
  (iv) manganese in an amount of about 3.5 to about 4.0 percent, by weight of the final composition;
  (v) chromium in an amount of about 6.0 to about 8.0 percent, by weight of the final composition;
  (vi) vanadium in an amount of about 0.1 to about 0.3 percent, by weight of the final composition;
  (vii) titanium in an amount of about 0.3 to about 0.6 percent, by weight of the final composition;

(b) pouring said melt into a cavity of a mold which defines a configuration of an article;

(c) cooling said melt to solidify said melt and form said article;

(d) forming a metastable non-cementite-type carbide in said article;

(e) annealing said article at a temperature of about 100° C. to about 400° C. below the solidus temperature of the material of said article for about three hours; and (f) plastically deforming said article.

8. The method according to claim 7 further comprising removing said article from said mold after a temperature of about 800° C. to about 900° C. is reached during cooling.

9. The method according to claim 7 wherein said melt of said preparing step (a) further comprises molydenum in an amount of about 0 to about 2.0 percent, by weight of the final composition.

10. The method according to claim 7 wherein said melt of said preparing step (a) further comprises aluminum in an amount of about 0 to about 0.15 percent, by weight of the final composition.

11. The method according to claim 8 wherein said plastically deforming step (f) takes place at a temperature ranging from about 860° C. to about 1100° C., and a strain rate ranging from about $10^{-3}s^{-1}$ to about $10^{3}s^{-1}$.

12. The method according to claim 7 wherein said metastable non-cementite-type carbide consists essentially of $M_7C_3$ type carbides, wherein M is one or more of the carbide-forming metal elements employed in said melt.

13. The method according to claim 12 wherein a phase transformation from $M_7C_3$ to $M_{23}C_6$ takes place during said plastically deforming step (f).

* * * * *

UNITED STATES PATENT AND TRADEMARK OFFICE

CERTIFICATE OF CORRECTION

PATENT NO. : 5,439,535

DATED : August 8, 1995

INVENTOR(S) : Leonid M. Snagovski et al

It is certified that error appears in the above-indentified patent and that said Letters Patent is hereby corrected as shown below:

Title page, item [75] fourth inventor: should read--
"Emil Y. Vasilev" should read --Emil Ya. Vasilev--.

Signed and Sealed this

Twenty-second Day of October, 1996

*Attest:*

Bruce Lehman

BRUCE LEHMAN

*Attesting Officer*

*Commissioner of Patents and Trademarks*